US006851250B2

(12) United States Patent
Whitby et al.

(10) Patent No.: US 6,851,250 B2
(45) Date of Patent: Feb. 8, 2005

(54) PACKAGE WRAPPING MACHINE WITH AUTOMATIC PACKAGE POSITIONING PRIOR TO WRAPPING

(75) Inventors: Michael A. Whitby, West Milton, OH (US); Lee E. Trouteaud, Tipp City, OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/996,221

(22) Filed: Nov. 28, 2001

(65) Prior Publication Data

US 2002/0062628 A1 May 30, 2002

Related U.S. Application Data

(60) Provisional application No. 60/253,844, filed on Nov. 29, 2000.

(51) Int. Cl.[7] ..... B65B 57/00; B65G 43/08

(52) U.S. Cl. ..... 53/493; 53/209; 53/557; 198/456; 198/572; 198/597

(58) Field of Search ..... 53/556, 493, 209, 53/557; 198/456, 341.05, 572, 584, 586, 597

(56) References Cited

U.S. PATENT DOCUMENTS

| | | | | | |
|---|---|---|---|---|---|
| 1,808,134 | A | * | 6/1931 | Gotthardt et al. | 198/349 |
| 2,030,816 | A | | 5/1936 | Fenton | |
| 2,310,160 | A | | 2/1943 | Cohen | |
| 2,334,384 | A | | 8/1943 | Cohen | |
| 2,959,269 | A | | 11/1960 | Kammerer | |
| 3,093,245 | A | | 6/1963 | Worcester et al. | |
| 3,621,973 | A | * | 11/1971 | Carlson et al. | 198/456 |
| 3,915,282 | A | * | 10/1975 | Remensperger | 198/456 |
| 4,089,517 | A | * | 5/1978 | Marass | 271/227 |
| 4,111,412 | A | | 9/1978 | Cathers | |
| 4,244,461 | A | * | 1/1981 | Fischer et al. | 198/456 |
| 4,349,097 | A | | 9/1982 | Curti | |
| 4,645,062 | A | | 2/1987 | Kopp | |
| 4,716,706 | A | * | 1/1988 | Boeckmann | 53/117 |
| 5,144,787 | A | | 9/1992 | Whitby et al. | |
| 5,238,099 | A | * | 8/1993 | Schroeder et al. | 198/456 |
| 5,299,693 | A | * | 4/1994 | Ubaldi et al. | 198/341.05 |
| 5,407,190 | A | * | 4/1995 | Hehn | 198/456 |
| 5,927,469 | A | * | 7/1999 | Dunifon et al. | 198/456 |
| 5,979,635 | A | | 11/1999 | Calhoun | |
| 6,170,236 | B1 | | 1/2001 | Whitby et al. | |

* cited by examiner

*Primary Examiner*—Louis Huynh
(74) *Attorney, Agent, or Firm*—Thompson Hine LLP

(57) ABSTRACT

A method for conveying a package to a wrap station of a package wrapping machine involves the steps of providing a conveying system for moving the package to the wrap station, the conveying system being selectively adjustable for varying a lateral position of a package; sensing a lateral position of the package as it travels along the conveying system; comparing the sensed lateral position of the package with a desired lateral position of the package; and based upon the comparison, adjusting the conveying system to place the package in the desired lateral position.

4 Claims, 8 Drawing Sheets

PACKAGE WRAPPING MACHINE WITH AUTOMATIC PACKAGE POSITIONING PRIOR TO WRAPPING

This application claims the benefit of U.S. provisional application No. 60/253,844 filed Nov. 29, 2000.

TECHNICAL FIELD

This application relates generally to package wrapping machines and, more particularly, to a system and method for positioning packages prior to entering a wrap location so that the package can be correctly wrapped.

BACKGROUND

Food product wrapping machines typically feed a trayed food product or package, such a ground meat or produce, to a wrap station at which a film is drawn out over the trayed food package, wrapped around the package, and passed to a heat sealing station. If a package is not properly positioned when it reaches the wrap station, a less than desirable wrap may result. In the past, machines have used arms along a defined conveying path that contact the sides of the package and causing off-center packages to be urged toward a centered position.

It would be desirable to provide a system and method for positioning food packages as they move along a conveying path that involves less direct contact with the food package.

SUMMARY

In one aspect, a package wrapping machine for wrapping packages includes a wrap station at which packages are wrapped and a film dispensing station for drawing out film over a package at the wrap station. A conveying system for moving packages along a defined path to the wrap station includes a first conveyor along a first portion of the defined path and a second conveyor along a second portion of the defined path. The first conveyor has an output end which feeds to an input end of the second conveyor for feeding a package traveling along the first conveyor to the second conveyor. At least one sensor is provided for determining a lateral position of a package moving along the first conveyor. At least one actuator is provided for controlling a relative lateral position of the output end of the first conveyor to the input end of the second conveyor. A controller receives signals from the sensor and controls the actuator, wherein, for a given package moving along the first conveyor, and based upon signals received from the sensor, the controller effects movement of the actuator to define a relative position between the output end of the first conveyor and the input end of the second conveyor to place the given package in a desired lateral position on the second conveyor.

In another aspect, a method for conveying a package to a wrap station of a package wrapping machine involves the steps of providing a conveying system for moving the package to the wrap station, the conveying system being selectively adjustable for varying a lateral position of a package traveling along the conveying system; sensing a lateral position of the package; comparing the sensed lateral position of the package with a desired lateral position of the package; and based upon the comparison, adjusting the conveying system to place the package in the desired lateral position.

In yet another aspect, a package wrapping machine includes an infeed station and a wrap station. A conveying system is configured to move the packages along a path from the infeed station to the wrap station, the conveying system being selectively adjustable to individually vary a lateral position of at least certain of the packages traveling along the path. A sensor is configured to detect a lateral position. A controller is configured to receive signals from the sensor and to control the selective adjustment of the conveying system to individually position at least certain of the packages in a desired position when they reach the wrap station.

DETAILED DESCRIPTION

Figure 8:
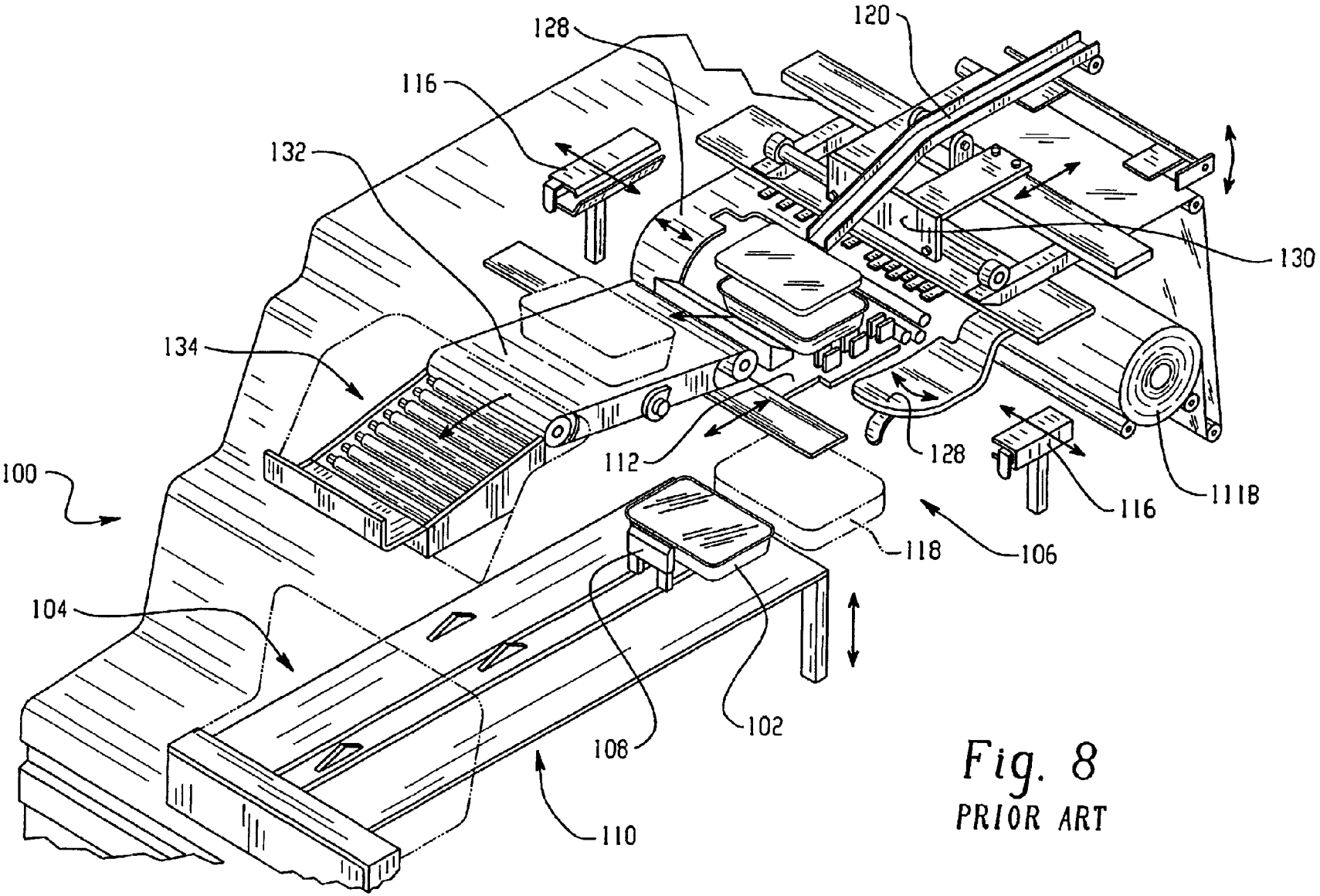
Fig. 8 PRIOR ART
FIG. 8 shows an exemplary prior art package wrapping machine.

Reference is made to U.S. Pat. No. 5,144,787, which discloses an exemplary food product package wrapping machine 100 that wraps meat, produce, or the like, in stretchable, heat-sealable film, an exemplary view of which is seen in FIG. 8 of the present application. The entire teachings of this patent are hereby incorporated by reference. Generally, a package 102 is fed into the machine 100 at an infeed station 104 and is carried along a package entryway 110 by a pusher 108 to an elevator 118. A raised position of the elevator 118 may at least partially define a wrap station 106. Before or when the package 102 reaches the wrap station 106, a film gripper 112 and side-clamps 116 cooperate to draw an appropriate amount of film from a source roll 111B out over the wrap station 106 and to stretch the film in a desired manner. The amount of drawn film is determined by a height of the package 102. The elevator 118 then moves the package 102 up through a plane of the stretched film and the film is wrapped around the package 102. A hold down arm 120 holds the wrapped film while the package 102 is being pushed by package pusher 130 toward side under folders 128. Finally, a heat sealing conveyor 132 receives and seals the wrapped film around the package 102 and brings the package 102 to a weigh station 134. Other wrapping machine variations having different wrapping station configurations could also be utilized.

Figure 7:
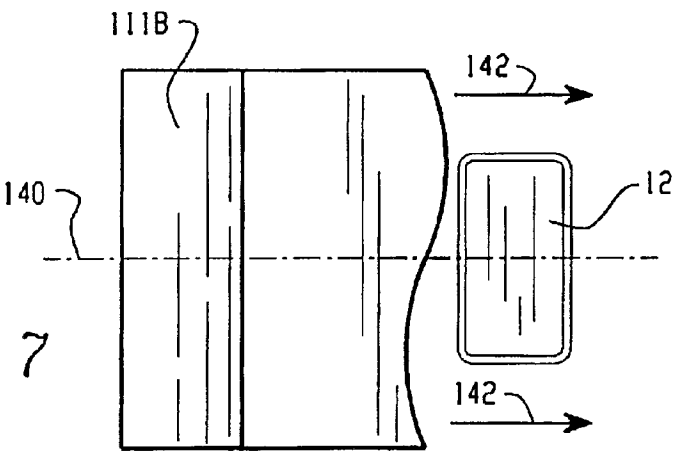
FIG. 7 shows a top view of a package at a wrap station.

In one embodiment, a conveying system 10 is used to convey a package 12 to a wrap station, such as station 106, where a portion of the conveying system 10 is selectively adjustable to vary a lateral position of the package 12 to center the package, or to locate the package to some other desired lateral position, before the package reaches the wrap station. FIG. 7 shows a top view of a package 12 in a desired centered, lateral position relative to a film dispensing axis 140, where film is drawn out over the package 12 in the direction of arrows 142.

Figure 1:
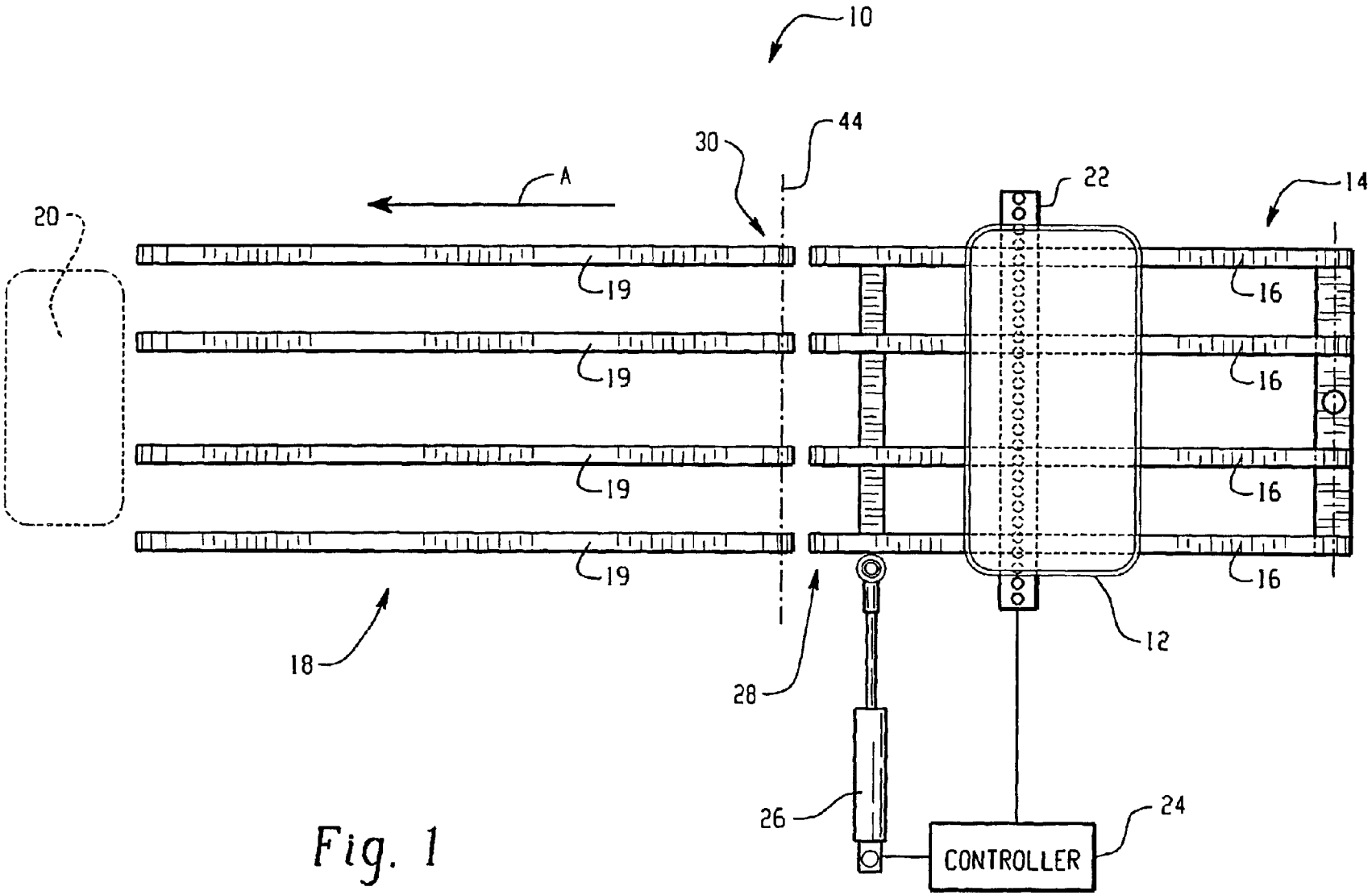
FIG. 1 illustrates a top view of a first state of a package positioning system in a package wrapping machine according to various embodiments of the present invention.

FIG. 1 illustrates a conveying system 10 in a first state. The first state may be a normal state before any part of the conveying system 10 is moved, and a second state may be an actuated state during which the conveying system 10 is moved to position the package 12. The package 12, which moves in the direction of arrow A, is positioned on a conveyor 14, which may be comprised of spaced apart belts 16. A defined path of travel of the package 12 may comprise feeding the package to an input of the conveyor 14, feeding the package 12 at an output end 28 of the conveyor 14 to an input end 30 of a conveyor 18, which may also be comprised of spaced apart belts 19, and feeding the package 12 to an elevator area 20. The elevator may be a receiving platform that is vertically movable and which at least partially defines the wrap station similar to wrap station 106 in the shown in FIG. 7. The conveying system 10 may include a sensor 22 positioned adjacent the first conveyor 14 and configured to produce signals indicative of a lateral position of the package 12. As used herein, the term "lateral position" of the package is intended to mean a position along the width of the conveying system 10, that is a position relative to an axis transverse to the direction of travel A. It is recognized that in some embodiments sensor 22 could also be positioned upstream of conveyor 14, for example at the location where an operator initially places the package on the machine. The signals may be received by controller 24, which compares a sensed lateral position of the package 12 to a desired lateral position of the package 12 and responsively outputs signals to an actuator 26 to effect adjustment of the actuator 26 to move the output end 28 of the conveyor 14 so as to place the package 12 in the desired lateral position when transferred to conveyor 18. For example, in one embodiment the controller 24 receives the signals from the sensor 22 and produces a value correlated to the sensed lateral position signals and compares the correlated value to a desired lateral position value, determining a difference between the two. If the difference is above or below a threshold level, the controller 24 then transmits a signal to the actuator 26. Once the actuator 26 receives the signal from the controller 24 it moves the output end 28 of the conveyor 14 relative to the input end 30 of the conveyor 18.

The actuator 26 may be configured as a motor and screw thread device with feedback or a stepper motor with feedback. In alternative embodiments, the actuator 26 can be configured as a pneumatic or hydraulic rod and cylinder type arrangement. In still further embodiments, the actuator 26 can be a cam mechanism. It is to be appreciated that the use of other actuator devices as is likewise contemplated, such as solenoid type displacement members.

The sensor 22 may comprise an array of optical sensors, such as infrared or visible light sensors that utilize make or break technology to determine the locations of the side edges of the package, and thus the lateral position of the package. In alternative embodiments, the sensor 22 can comprise an array of mechanical switches triggered by contact with the bottom of the package 12. It is to be appreciated that the use of other sensor devices is likewise contemplated.

Figure 2:
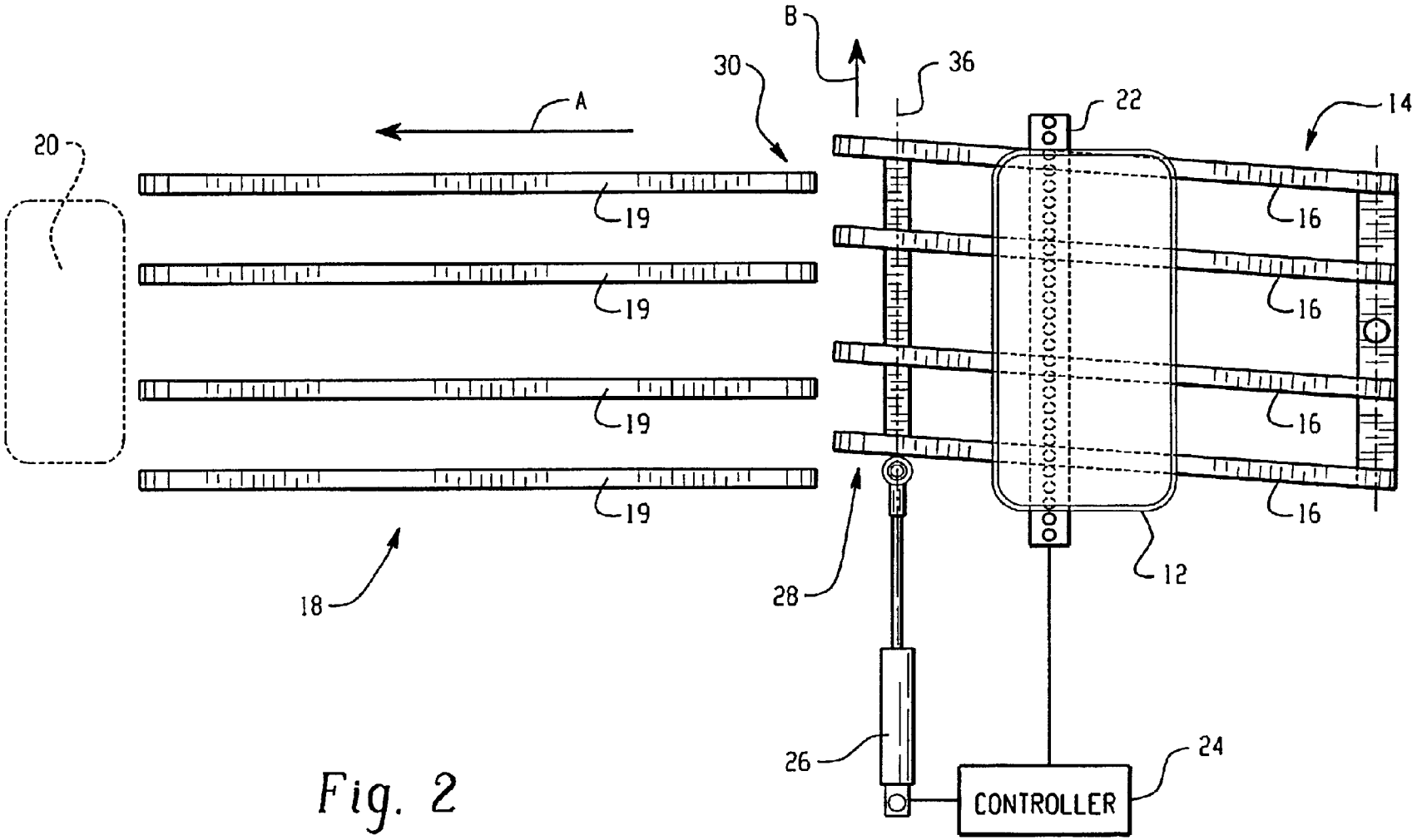
FIG. 2 illustrates a top view of a second state of one embodiment of a package positioning system in a package wrapping machine.

FIG. 2 shows actuation of the conveying system 10 into a second state according to one embodiment. The second state is initiated when the controller 24 determines the package 12 is not in the desired lateral position, which may be a centered position. In this embodiment the actuator 26 may be configured to move the output end 28 of the conveyor 14 laterally in the direction of arrow B and linearly along an axis 36, while the input end of the conveyor 14 remains stationary as shown. The output end 28 could also be moved in a direction opposite arrow B if needed. The input end 30 of conveyor 18 remains stationary. Thus, the package 12 rotatably slides relative to the belts 16 and is moved to a desired position, which may be a centered position, on the belts 19 of conveyor 18.

Figure 3:
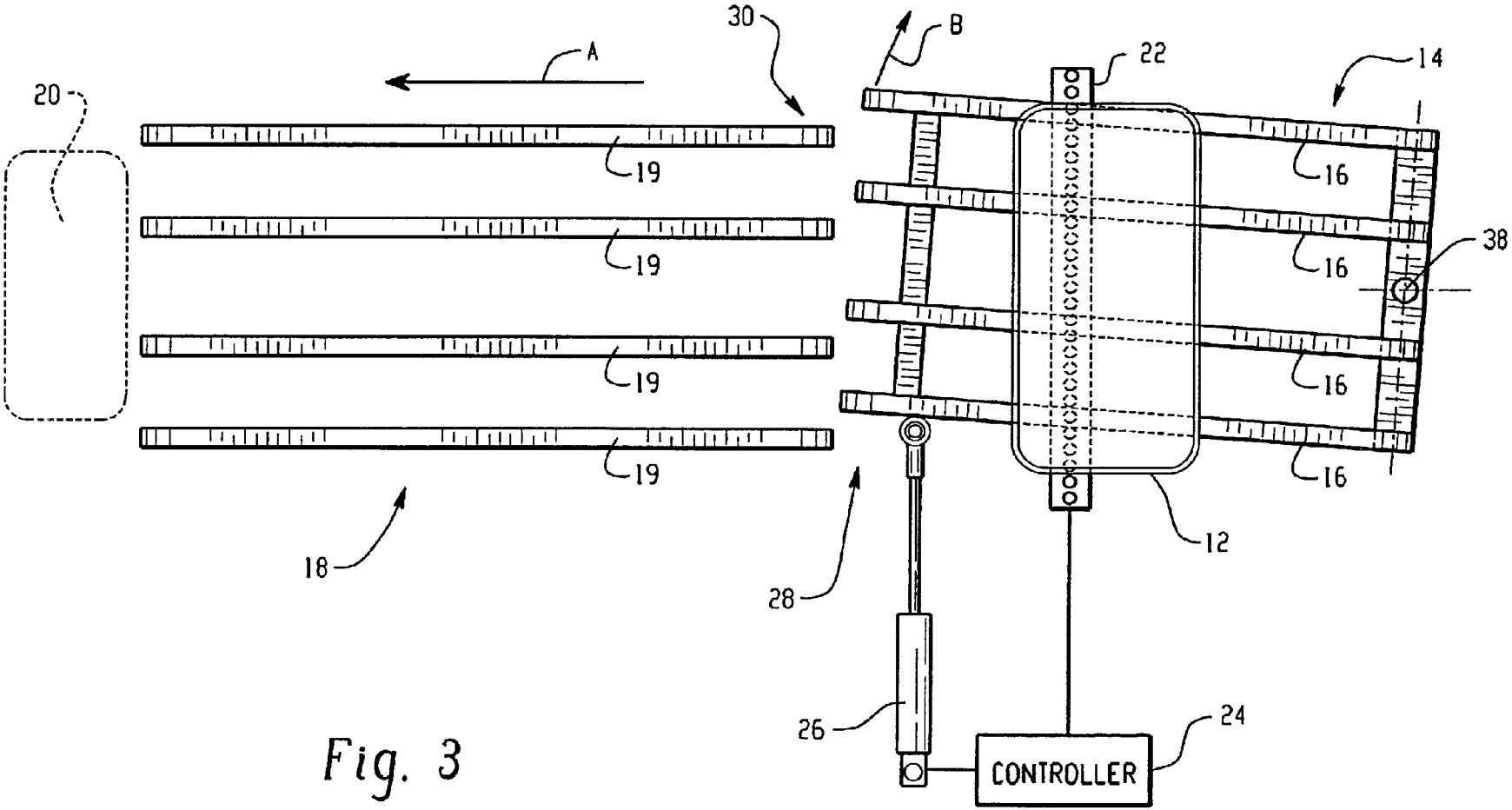
FIG. 3 illustrates a top view of a second state of another embodiment of a package positioning system in a package wrapping machine.

FIG. 3 shows actuation of the conveying system 10 into a second state according to another embodiment. In this embodiment the actuator 26 may be configured to move the output end 28 of the conveyor 14 laterally in the direction of arrow B and pivoting around pivot point 38, while the input end of conveyor 14 also pivots about point 38 as shown. The output end 28 could also be moved in a direction opposite arrow B if needed. The input end 30 of conveyor 18 remains stationary. Thus, the package 12 is moved to a desired position, which may be a centered position, on the belts 19 of conveyor 18.

Figure 4:
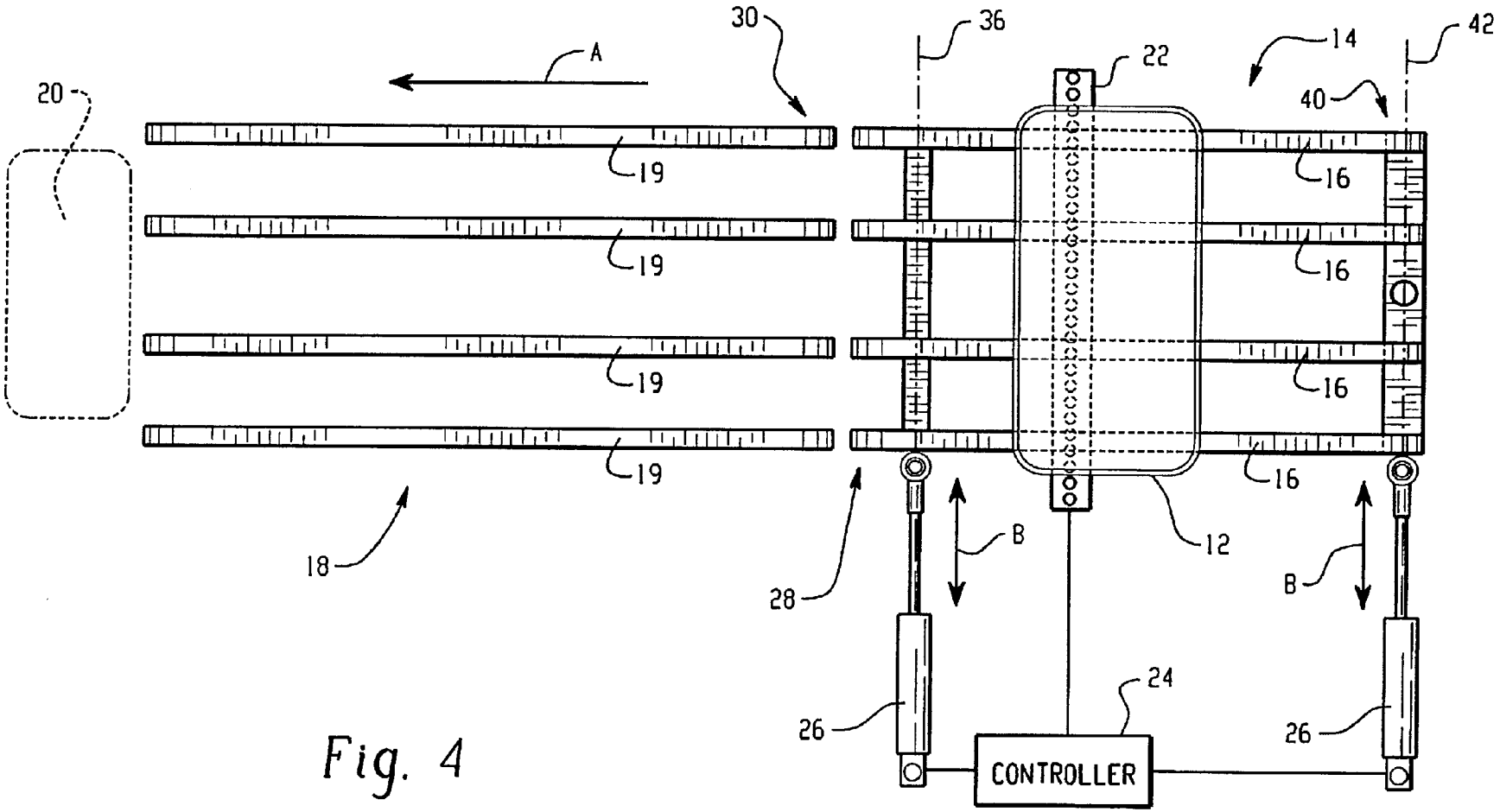
FIG. 4 illustrates a top view of another embodiment of a package positioning system in a package wrapping machine.

FIG. 4 shows another embodiment in which two actuators 26 are configured to move the output end 28 and an input end 40 of the conveyor 14 laterally in the direction of arrow B along axes 36 and 42, respectively. The input end 30 of conveyor 18 remains stationary. Thus, the package 12 is moved to a desired position, which may be a centered position, on the belts 19 of conveyor 18.

Figure 5A:
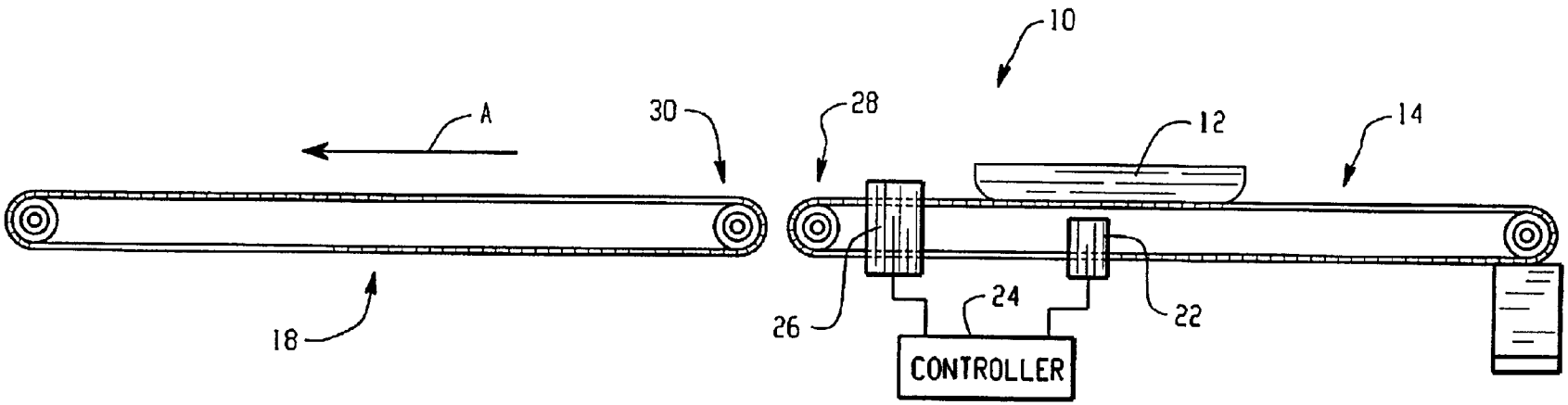
FIGS. 5A–5B illustrate side views of a package positioning system in a package wrapping machine according to various embodiments of the present invention.
Figure 5B:
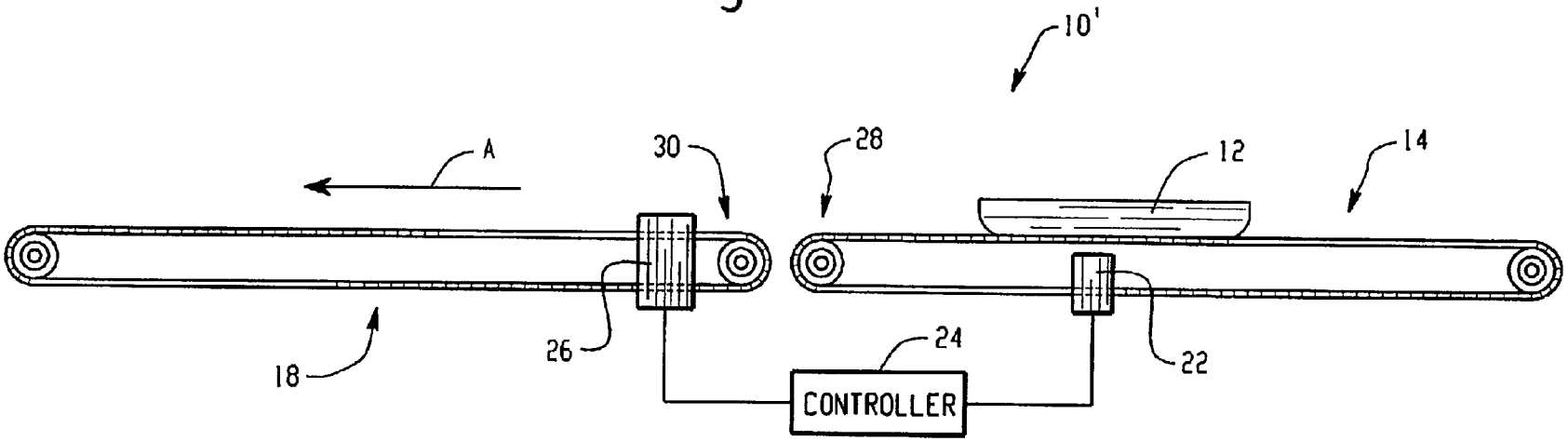

Turning now to FIGS. 5A and 5B, a side view of the conveying system 10 according to two embodiments is shown. In particular, FIG. 5A represents an embodiment such as those shown in FIGS. 1–3. In FIG. 5B, a configuration of a conveying system 10' is shown where the actuator 26 is located adjacent the input end 30 of the conveyor 18. Thus, when the controller 24 receives the signal from the sensor 22 that the package 12 is not in the desired lateral position, the controller 24 transmits a signal to the actuator 26 that causes it to move the input end 30 of conveyor 18 laterally in the direction of arrow B (FIGS. 2–3) along axis 44 (FIG. 1), while the output end 28 of conveyor 14 remains stationary. Hence, the package 12 leaves conveyor 14 and enters conveyor 18 at a desired, controlled lateral position on the belts 19. The conveyor 18 can then be moved back to its normal position so the package is at a desired lateral position when it reaches the downstream wrap station.

Figure 6C:
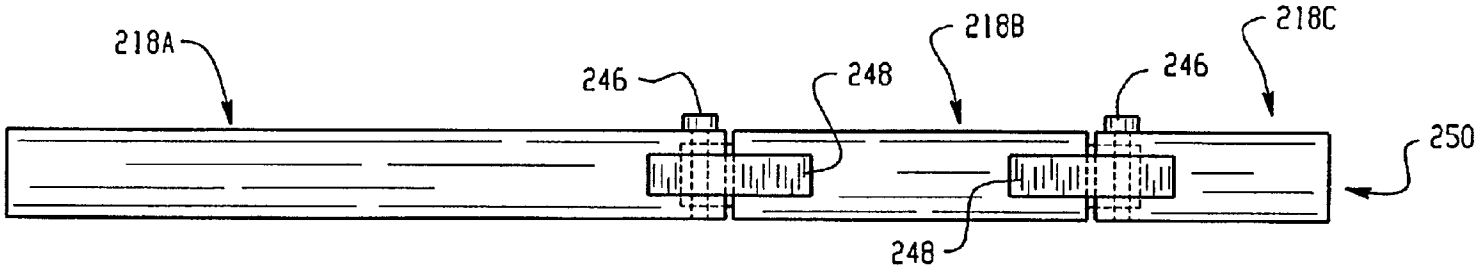
FIG. 6C illustrates a right side elevation view of FIG. 6A.
Figure 6A:
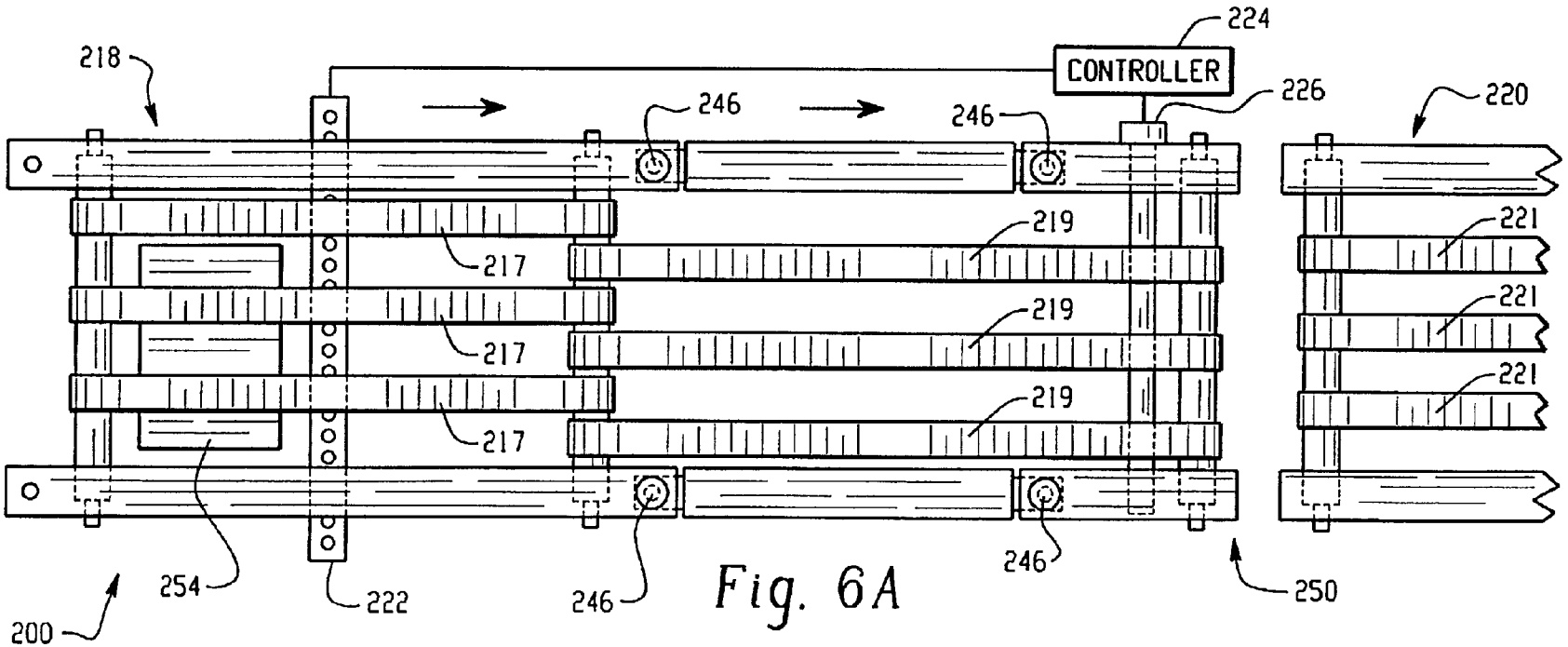
FIGS. 6A–6B illustrate top views of a first and second state of a package positioning system in a package wrapping machine according to another embodiment of the present invention.
Figure 6B:
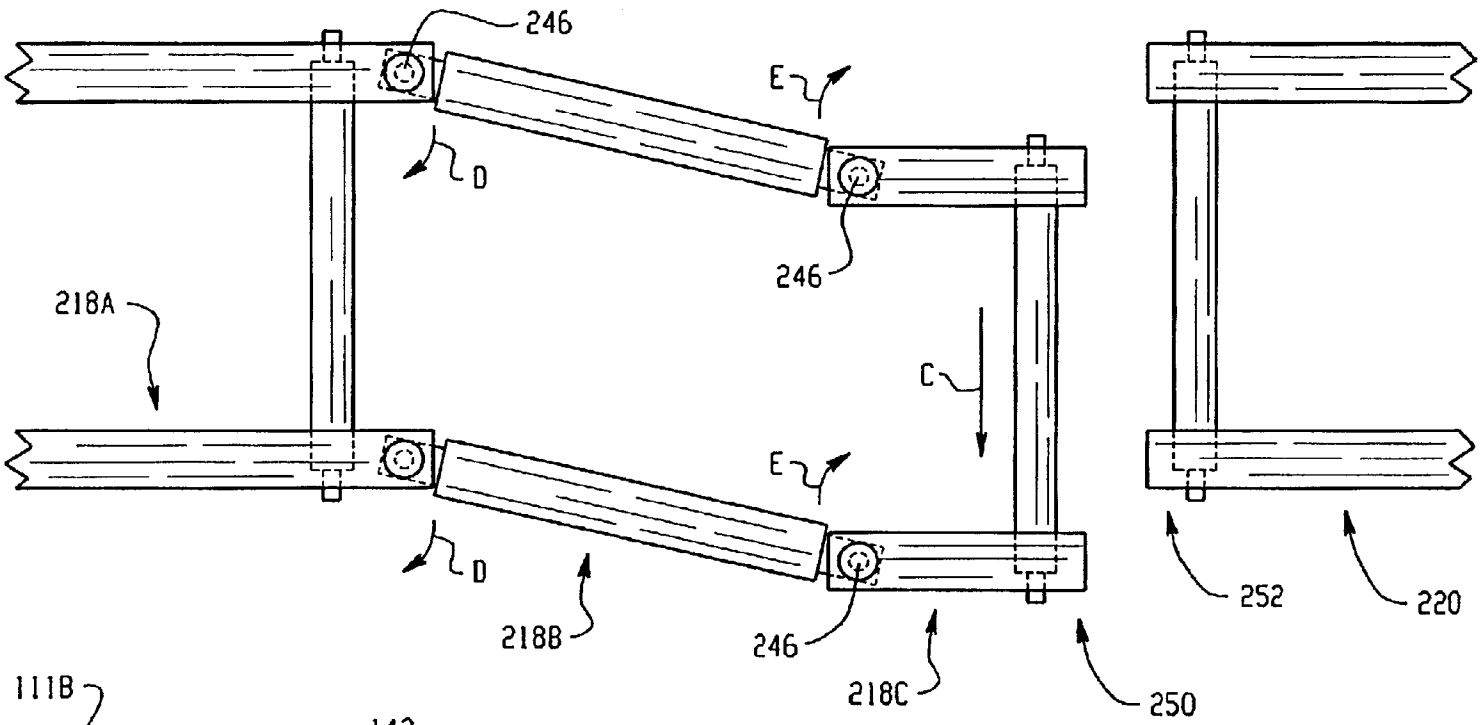

With reference to FIGS. 6A–6C, another embodiment of a conveying system 200 is shown. Similar elements contain similar reference numbers to FIGS. 1–5B, but have a 200 series designation. For example a sensor 222 adjacent a conveyor 218 is similar to the sensor 22. FIG. 6A shows a first state of the conveying system 200, in which the conveyor 218 is comprised of pivotally connected first, second, and third conveying sections 218A–C, respectively, which pivot around pivot devices 246 and are interconnected through use of connecting devices 248. The pivoting devices 246 may be pins or bolts and the connecting devices 248 may be metallic, plastic, or elastomer hinges, or the like, that connect the conveying sections 218A–C, respectively, in a pivoting manner. A first set of belts 217 conveys the package (not shown for convenience) from the first conveying section 218A to the second conveying section 218B, and a second set of belts 219 conveys the package from the second conveying section 218B to the exit end of conveyor 128 which may feed an elevator area or another conveyor 220, which includes a set of belts 221. The conveying system 200 may also comprise a weighing area 254 adjacent the sensor 222. The weighing area 254 may include portions extend upward between the belts 217 for resting the package thereon, and the belts may include spaced pushers for extending therefrom to move the packages off of the weighing area.

FIG. 6B shows a second state of the conveying system 200. The second state is initiated when the controller 224 determines the package (not shown) is not in a desired lateral position, which may be a centered position. When this occurs, a signal is sent from the controller 224 to the actuator 226 to move an output end 250 of the conveyor 218 in the direction of arrow C, while an input end 252 of the conveyor 220 remains stationary. When the actuator 226 moves the output end 250, the second conveying section 218B pivots around pivot device 246 relative to the first conveying section 218A in the direction of arrow D, while the first section 218A remains stationary. Also, when the actuator 226 moves the output end 250, the second section 218B pivots around pivot device 246 relative to the third conveying section 218C in the direction of arrow E, while the third section 218C moves in the direction of arrow C. Such controlled movement of conveying system 200 places the package in a desired lateral position as it leaves conveying section 218E.

Although the invention has been described and illustrated in detail it is to be clearly understood that the same is intended by way of illustration and example only and is not intended to be taken by way of limitation. Other changes and modifications could be made without departing from the invention. For example, while various embodiments of conveying systems are shown and described herein, other variations could be utilized, such as the conveying system shown and described in U.S. Pat. No. 5,238,099, the entire specification of which is hereby incorporated by reference. Additionally, while the subject system is described primarily with reference to the package wrapping machine shown in FIG. 8, it is recognized that many variations of package wrapping machines are possible, such as that shown in U.S. Pat. No. 6,170,236B1. Still further, while various embodiments described herein utilize first and second conveyors back to back, conveying systems having only a single conveyor that is laterally adjusted are also contemplated.

Still further, it is recognized that in some embodiments the package elevator that raises the packages up into the drawn out film may be considered part of the conveying system. In such embodiments the position of the package elevator could be laterally adjusted to provide desired positioning of the package. In one variation of this type, the lateral position of package elevator could be adjusted so that each package is received on the elevator in a desired, for example centered, position on the elevator, and the elevator could then be moved laterally back to its own centered position relative to the film dispensing axis prior to, or as the elevator is raised upward. In another variation, the elevator could always be located at the same position to receive packages, in which case some packages would be off-center relative to the elevator, and then the lateral position of the elevator could be adjusted to center the package relative to the film dispensing axis as the elevator is raised upward. In either case, the elevator could be mounted to a frame that is movable along at least one guide rod. In one case the guide rod could be part of a screw type drive engaging corresponding threads on the elevator frame and rotated to adjust the lateral position of the elevator. In another case the frame could simply slide along the rod and a separate actuator could be used to push/pull the frame along the rod.

Another contemplated embodiment could provide a conveyor output end in which only the conveyor roller is moved laterally along a guide rod by an actuator, such that the side rails of the conveyor might not be moved. An actuator could be provided to move the conveyor roller.

Accordingly, the spirit and scope of the invention are to be limited only by the terms of the appended claims.

What is claimed is:

1. A wrapping machine for wrapping trayed food products, comprising:

a wrap station at which trayed food products are wrapped;

a film dispensing station for drawing out film over trayed food products at the wrap station;

a conveying system for moving trayed food products along a defined path to the wrap station including:

a first conveyor along a first portion of the defined path;

a second conveyor along a second portion of the defined path, the first conveyor having an output end which is aligned at a height with and feeds to an input end of the second conveyor for feeding trayed food products traveling along the first conveyor to the second conveyor;

at least one sensor for determining a lateral position of trayed food products moving along the first conveyor, the sensor comprising an optical sensor arrangement positioned to avoid direct contact with trayed food items;

at least one actuator for controlling a relative lateral position between the output end of the first conveyor and the input end of the second conveyor;

a controller for receiving signals from the sensor and for controlling the actuator, wherein, for a given trayed food product moving along the first conveyor, and based upon signals received from the sensor, the controller effects movement of the actuator to define a relative lateral position between the output end of the first conveyor and the input end of the second conveyor to place the given trayed food product in a desired lateral position on the second conveyor, wherein the actuator is connected for moving the output end of the first conveyor along a linear laterally extending axis while an input end of the first conveyor remains laterally stationary.

2. A wrapping machine for wrapping trayed food products, comprising:

a wrap station at which trayed food products are wrapped;

a film dispensing station for drawing out film over trayed food products at the wrap station;

a conveying system for moving trayed food products along a defined path to the wrap station including:

a first conveyor along a first portion of the defined path;

a second conveyor along a second portion of the defined path, the first conveyor having an output end which is aligned at a height with and feeds to an input end of the second conveyor for feeding trayed food products traveling along the first conveyor to the second conveyor;

at least one sensor for determining a lateral position of trayed food products moving along the first conveyor, the sensor comprising an optical sensor arrangement positioned to avoid direct contact with trayed food items;

at least one actuator for controlling a relative lateral position between the output end of the first conveyor and the input end of the second conveyor;

a controller for receiving signals from the sensor and for controlling the actuator, wherein, for a given trayed food product moving along the first conveyor, and based upon signals received from the sensor, the controller effects movement of the actuator to define a relative lateral position between the output end of the first conveyor and the input end of the second conveyor to place the given trayed food product in a desired lateral position on the second conveyor, wherein the actuator is connected for moving the input end of the second conveyor along a linear laterally extending axis while an output end of the second conveyor remains laterally stationary.

3. A trayed food product wrapping machine for wrapping packages, comprising:

a wrap station at which trayed food products are wrapped;

a film dispensing station for drawing out film over trayed food products at the wrap station;

a conveying system for moving trayed food products along a defined path to the wrap station, the conveying system being selectively adjustable for varying a lateral position of trayed food products traveling along the path, the conveying system including a first conveyor along a first portion of the defined path, a second conveyor along a second portion of the defined path, the first conveyor having an output end which is aligned at a height with and feeds to an input end of the second conveyor for feeding trayed food products traveling along the first conveyor to the second conveyor;

at least one sensor for determining lateral position of trayed food products;

a controller for receiving signals from the sensor and for controlling adjustment of the conveying system, wherein, for a given trayed food product moving along the path, and based upon signals received from the sensor, the controller effects adjustment of the conveying system to define a relative lateral position between the output end of the first conveyor and the input end of the second conveyor so as to establish a desired lateral position of the given trayed food product when the given trayed food product reaches the wrap station, wherein the conveying system includes an actuator that is connected for moving the output end of the first conveyor along a linear laterally extending axis in response to said controller while an input end of the first conveyor remains laterally stationary.

4. A trayed food product wrapping machine for wrapping packages, comprising:

a wrap station at which trayed food products are wrapped;

a film dispensing station for drawing out film over trayed food products at the wrap station;

a conveying system for moving trayed food products along a defined path to the wrap station, the conveying system being selectively adjustable for varying a lateral position of trayed food products traveling along the path, the conveying system including a first conveyor along a first portion of the defined path, a second conveyor along a second portion of the defined path, the first conveyor having an ouput end which is aligned at a height with and feeds to an input end of the second conveyor for feeding trayed food products traveling along the first conveyor to the second conveyor;

at least one sensor for determining lateral position of trayed food products;

a controller for receiving signals from the sensor and for controlling adjustment of the conveying system, wherein, for a given trayed food product moving along the path, and based upon signals received from the sensor, the controller effects adjustment of the conveying system to define a relative lateral position between the output end of the first conveyor and the input end of the second conveyor so as to establish a desired lateral position of the given trayed food product when the given trayed food product reaches the wrap station, wherein the conveying system includes an actuator that is connected for moving the input end of the second conveyor along a linear laterally extending axis in response to said controller while an output end of the second conveyor remains laterally stationary.

* * * * *

UNITED STATES PATENT AND TRADEMARK OFFICE

CERTIFICATE OF CORRECTION

PATENT NO. : 6,851,250 B2
DATED : February 8, 2005
INVENTOR(S) : Michael A. Whitby et al.

It is certified that error appears in the above-identified patent and that said Letters Patent is hereby corrected as shown below:

Column 7,
Line 35, change "the path" to -- the defined path --.

Column 8,
Line 28, change "the path" to -- the defined path --.

Signed and Sealed this

Sixth Day of June, 2006

JON W. DUDAS
*Director of the United States Patent and Trademark Office*